United States Patent [19]

Barra

[11] Patent Number: 5,060,941

[45] **Date of Patent: * Oct. 29, 1991**

[54] ELECTRONIC REACTION-TIME GAME TOY

[76] Inventor: James M. Barra, 14802 Florida Ave., Apt. V-340, Tampa, Fla. 33613

[ * ] Notice: The portion of the term of this patent subsequent to Apr. 3, 2007 has been disclaimed.

[21] Appl. No.: 491,830

[22] Filed: Mar. 13, 1990

Related U.S. Application Data

[63] Continuation-in-part of Ser. No. 279,819, Dec. 5, 1988, which is a continuation-in-part of Ser. No. 90,856, Aug. 31, 1987, Pat. No. 4,789,155.

[51] Int. Cl.[5] ..... A63B 67/00

[52] U.S. Cl. ..... 273/85 R; 273/460

[58] Field of Search ..... 273/1 GC, 1 GE, 1 G, 273/88, 85 R, 93 R, 94, 138 A, 141 A, 142 B, 86 R, 86 B, 85 G, DIG. 28; 434/258

[56] References Cited

U.S. PATENT DOCUMENTS

| | | | |
|---|---|---|---|
| 2,491,888 | 12/1949 | Baker | 273/1 E |
| 3,208,747 | 9/1965 | Kavakos | 434/258 X |
| 3,346,968 | 10/1967 | Dellinger | 434/258 |
| 3,654,710 | 4/1972 | Barnard | 434/258 |
| 3,657,456 | 4/1972 | Kozak | 434/258 |
| 3,770,269 | 11/1973 | Elder | 273/1 E |
| 3,933,354 | 1/1976 | Goldfarb et al. | 273/1 E |
| 4,006,539 | 2/1977 | Slomski | 434/258 |
| 4,169,592 | 10/1979 | Hall | 273/1 E |
| 4,298,198 | 11/1981 | Huang et al. | 273/1 GC |
| 4,358,275 | 11/1982 | Paraghamian | 434/258 |
| 4,508,511 | 4/1985 | McQueen | 434/258 |
| 4,789,155 | 12/1988 | Barra | 273/1 GE |
| 4,913,432 | 4/1990 | Barra | 273/1 GC |

*Primary Examiner*—Edward M. Coven
*Assistant Examiner*—Sebastiano Passaniti
*Attorney, Agent, or Firm*—Charles A. McClure

[57] ABSTRACT

A competitive electronic game toy for one or more players, dependent upon personal reaction time and hand-eye coordination. Players manually trigger the sequencing of lights along one or two paths having successive segments bearing award indicia of a selected game or sport, and also manually halt the sequencing at will. The segments are marked with award indicia of a selected game or sport, and may be point scores or instructions to add or delete turns or for simulated playing of a game or sport, such as baseball. The players, striving to be awarded a high score or good play, try to stop the light sequencing at a path sgement with favorable indicia.

20 Claims, 4 Drawing Sheets

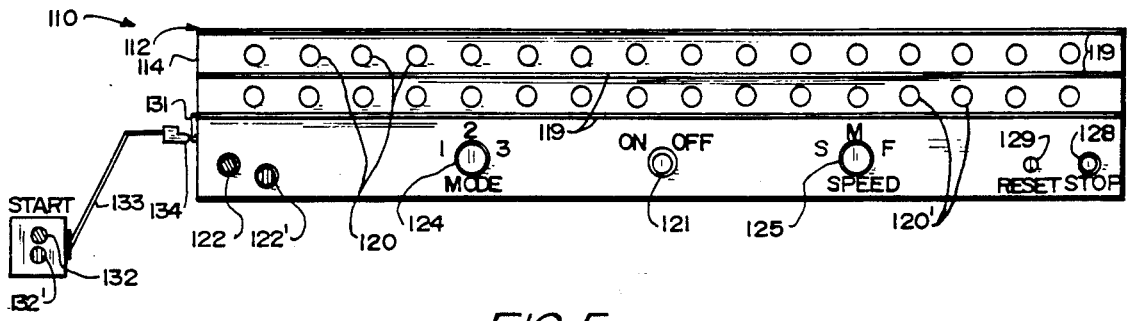
FIG. 5
FIG. 6
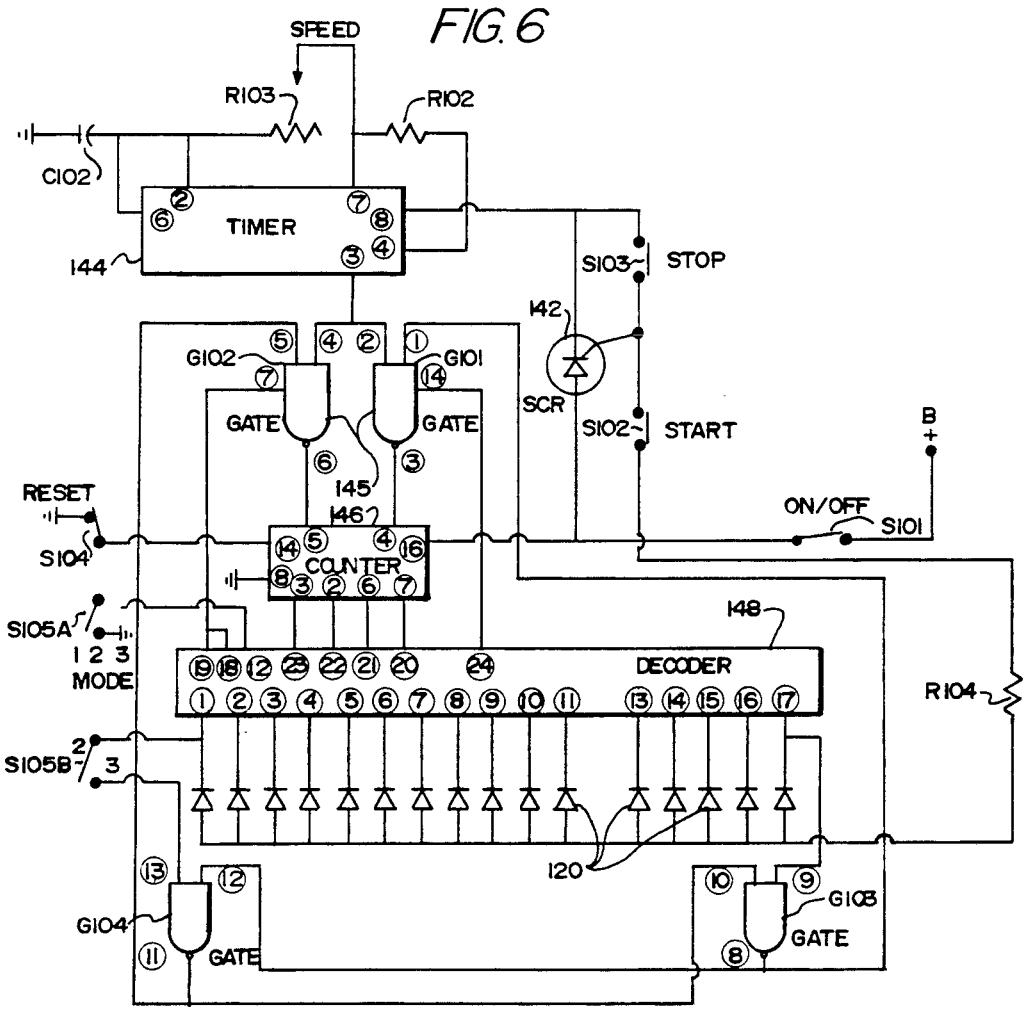

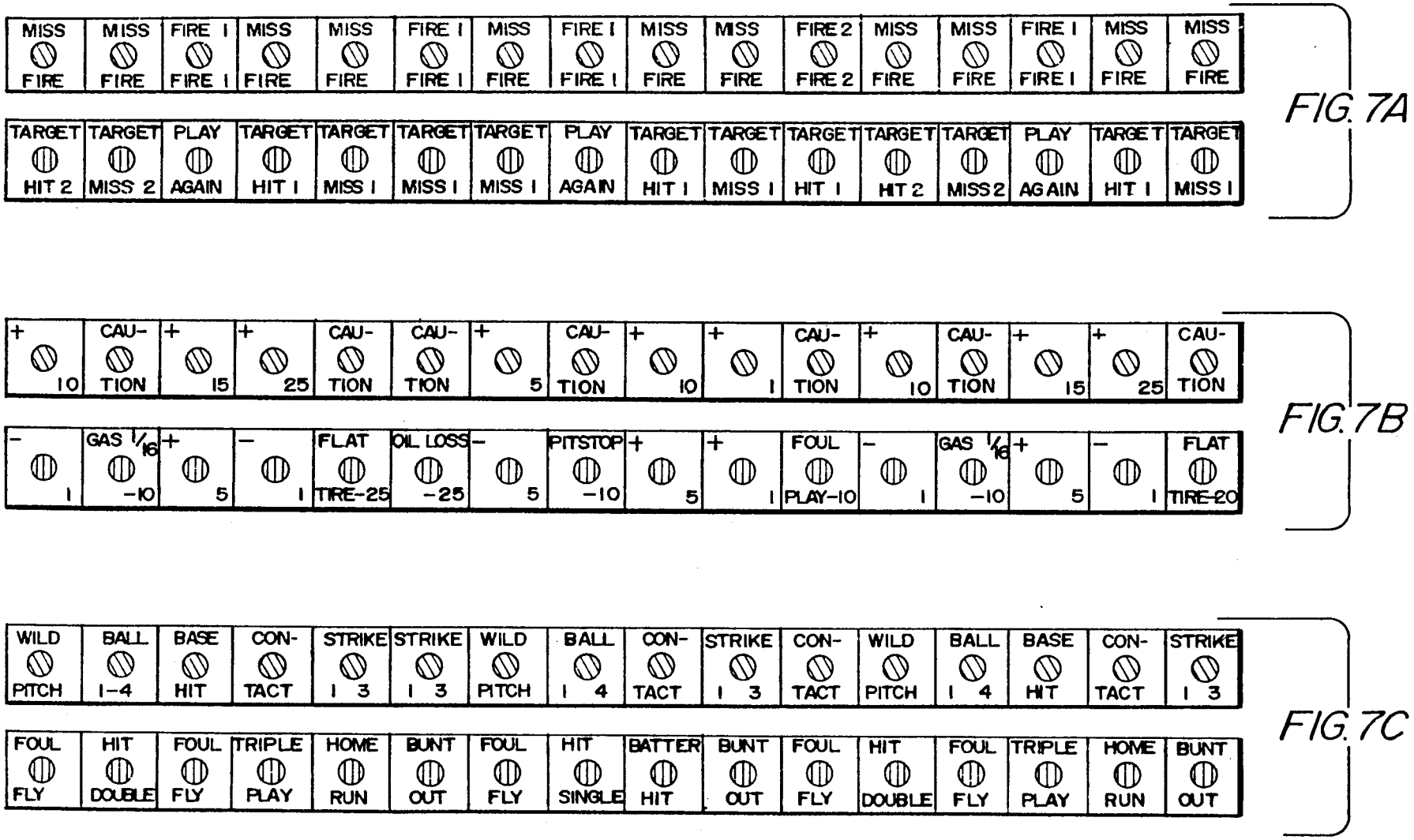
FIG. 7A
MISS FIRE
MISS FIRE
FIRE 1 FIRE 1
MISS FIRE
MISS FIRE
FIRE 1 FIRE 1
MISS FIRE
MISS FIRE
FIRE 2 FIRE 2
MISS FIRE
MISS FIRE
FIRE 1 FIRE 1
MISS FIRE
MISS FIRE
TARGET HIT 2
TARGET MISS 2
PLAY AGAIN
TARGET HIT 1
TARGET MISS 1
TARGET MISS 1
PLAY AGAIN
TARGET HIT 1
TARGET MISS 1
TARGET HIT 1
TARGET HIT 2
TARGET MISS 2
PLAY AGAIN
TARGET HIT 1
TARGET MISS 1
FIG. 7B
+ 10
CAU- TION
+ 15
+ 25
CAU- TION
CAU- TION
+ 5
CAU- TION
+ 10
+ 1
CAU- TION
+ 10
CAU- TION
+ 15
+ 25
CAU- TION
- 1
GAS 1/16 + -10
- 5
- 1 FLAT TIRE-25
OIL LOSS - -25
5
PITSTOP + -10
+ 5
+ 1
FOUL PLAY-10
- 1
GAS 1/16 + -10
+ 5
- 1
FLAT TIRE-20
FIG. 7C
WILD PITCH
BALL 1-4
BASE HIT
CON- TACT
STRIKE 1 3
WILD PITCH
BALL 1 4
CON- TACT
STRIKE 1 3
CON- TACT
WILD PITCH
BALL 1 4
BASE HIT
CON- TACT
STRIKE 1 3
FOUL FLY
HIT DOUBLE
FOUL FLY
TRIPLE PLAY
HOME RUN
BUNT OUT
FOUL FLY
HIT SINGLE
BATTER HIT
BUNT OUT
FOUL FLY
HIT DOUBLE
FOUL FLY
TRIPLE PLAY
HOME RUN
BUNT OUT

ELECTRONIC REACTION-TIME GAME TOY

This is a continuation-in-part of my copending patent application Ser. No. 279,819, filed Dec. 4, 1988, due to issue as a patent--which itself was a continuation-in-part of my then copending application, Ser. No. 90,856 filed Aug. 31, 1987, now U.S. Pat. No. 4,789,155.

FIELD OF THE INVENTION

This invention relates to a toy for playing a competitive game such as a simulated sport, alone or with one or more opponents, and concerns especially a time-reaction toy having a manually triggered indicator that is also manually arrestable and is adapted to select points to be scored or plays to be made.

BACKGROUND OF THE INVENTION

Competitive game toys diverge toward two diverse classes, game boards with chance-related play determinants (e.g., dice, spinners) and complex structurally modeled simulations, such as car or horse races and most recently animated video games. A gap exists for game toys with which players may exercise an important physical skill to determine plays in simulated sports and/or game points otherwise. One such skill is hand-eye coordination; another is reaction rate. My competitive game toy is designed to improve such physical skills, while leaving considerable scope for mental prowess in playing a simulated sport or other game of skill.

SUMMARY OF THE INVENTION

In general, the objects of this invention are attained via manually triggered indicator lights traversable along at least one path divided into successive intervals, and STOP means adapted to be manually actuated to halt the indicator lights traversal therealong.

A primary object of the present invention is to improve each player's hand-eye coordination and rate of reaction.

Another object of this invention is to provide a competitive game toy usable by either one player, two players, or even more than two players.

A further object of the invention is to make such toy suitable for players of low, intermediate, and high physical skill levels by providing ready adjustability of the indicator traversing rate.

Yet another object is to extend this invention to an electronic embodiment to supplement my previous development of mechanical and electro-mechanical embodiments.

Other objects of this invention, together with methods and means for accomplishing the various objects, will be apparent from the following description and from the accompanying drawings of a preferred embodiment and variants thereof, which are presented here by way of example rather than limitation.

BRIEF DESCRIPTION OF THE DRAWINGS

FIG. 5 is an exterior plan view of a somewhat more complex second embodiment of electronic game toy of this invention;

FIG. 6 is a schematic diagram of another embodiment of electronic circuitry of this invention useful in such second apparatus;

FIGS. 7A through 7F are embodiments of game overlays for use in the latter apparatus.

DETAILED DESCRIPTION OF THE INVENTION

Figure 1:
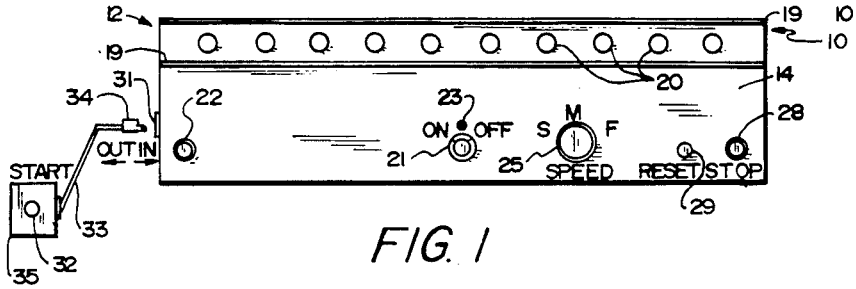
FIG. 1 is an exterior plan view of a relatively simple first embodiment of electronic game toy of this invention.

FIG. 1 shows first embodiment 10 of the game toy 10 this invention viewed from above, showing top 14 of rectangular housing 12 and featuring row of ten indicator lights 20 parallel to a longitudinal edge, flanked above and below by pair of edge guides 19 for holding a translucent overlay strip over the lights. Near the center is small monitor light 23 controlled by adjacent ON/OFF toggle switch push-button 21. Symmetrically placed near left and right corners are START button 22 and STOP button 28, respectively. Located between the ON/OFF and STOP buttons is SPEED control knob 25, which has adjacent markings: S (slow), M (medium), and F (fast). At the left edge of the housing is jack 31. Shown unplugged is plug 34 on an end of extension cord 33 to auxiliary START switch button 32 in switch box 35.

Figure 2:
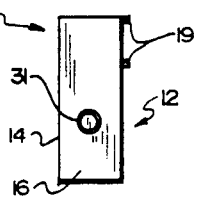
FIG. 2 is a left end elevation of the apparatus of FIG. 1.

FIG. 2 shows small rectangular end 16 of housing 12 end-on with jack 31 not occupied by the auxiliary START plug previously shown. Edge guides 19 are shown projecting above the left edge of top surface 12 of housing 14. In practice they can be recessed if desired.

Figure 3:
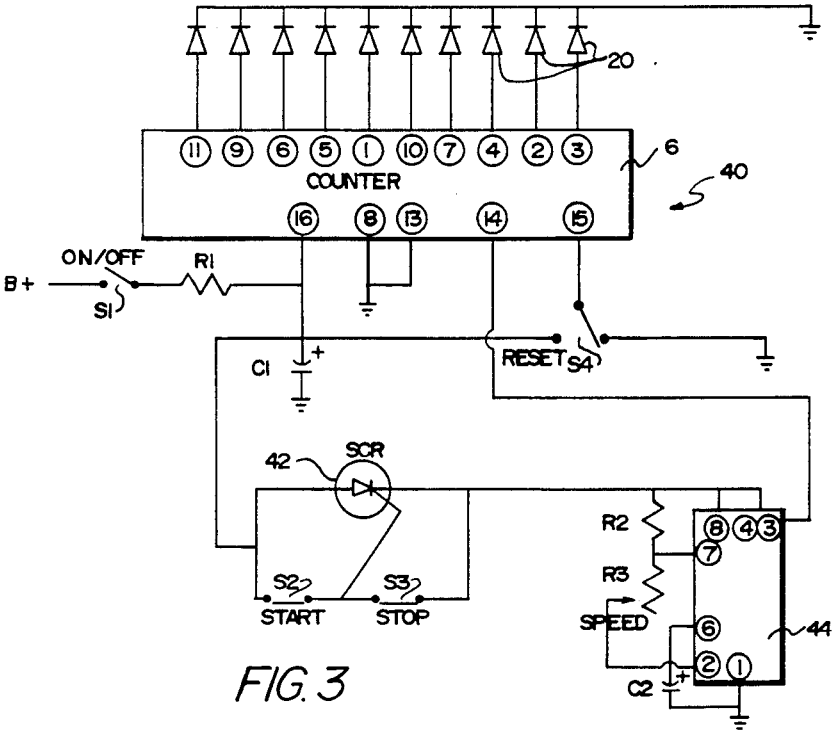
FIG. 3 is a schematic diagram of an embodiment of electronic circuitry of this invention useful in such first apparatus.

FIG. 3 shows circuitry 40 useful in housing 12 (also previously shown). Pin numbers of integrated circuits or circuit elements are shown encircled (without lead lines) to distinguish them from other reference numerals. Positive operating potential B+ from a battery or a rectifier circuit (not shown) is connected through an RC subcircuit--comprising series resistor R1 and capacitor C1 to ground--to the anode of SCR (silicon controlled rectifier) 42, whose cathode connects downstream to TIMER 44 (e.g., 555 chip). The SCR grid connects between a contact of normally open (n.o.) START switch S2 (whose other contact also goes to B+) and one contact of n.o. STOP switch S2, whose other contact connects to the SCR cathode.

Also connected to the SCR cathode in FIG. 3 are TIMER pins 4 (reset) and 8 ($+V_{cc}$) and--through resistor R2--pin 7 (discharge). SPEED control adjustable resistor R3 is connected between TIMER pins 2 (trigger) and 7. TIMER pin 1 (ground) is connected directly to ground, and pin 6 (threshold) is connected to ground through capacitor C2. A lead from pin 3 (output) of TIMER 44 connects to pin 14 (clock) of COUNTER 46 (such as Johnson decade chip 4017).

COUNTER pin 16 ($V_{DD}$) is connected to B+ through R1, and pins 8 ($V_{SS}$) and 13 (clock enable) are grounded, while pin 15 (reset) connects to the arm of RESET switch S4 connected to ground in its customary RUN position but manually deflectable to RESET position to connect to the SCR anode. Pins 1 through 7 and 9 through 11 of the COUNTER connect (in the output order shown) to ten respective LED's (light-emitting diodes) 20, whose other leads are grounded. It will be understood that switches S1, S2, S3, and S4 shown here are actuated by respective push-buttons 21, 22, 28, and 29 (in FIG. 1).

Figure 4C:
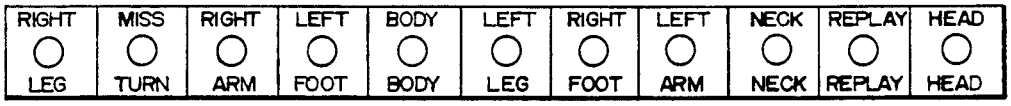
FIGS. 4A through 4E are game overlay embodiments adapted for use in the foregoing apparatus.
Figure 4D:
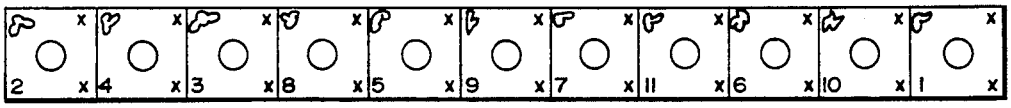
Figure 4B:
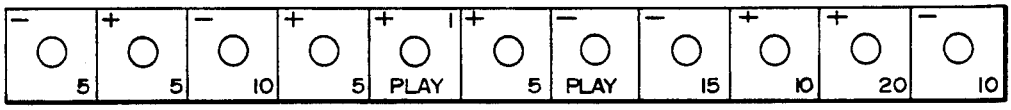
Figure 4E:
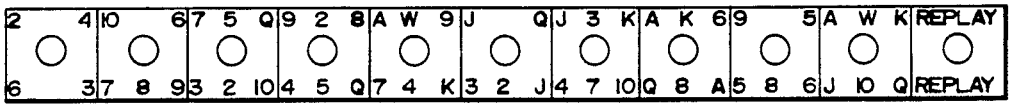
Figure 4A:
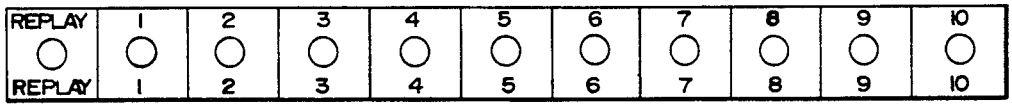

FIGS. 4A through 4E show translucent overlay strips 51 to 55 for indicator lights 20, with the indicator lights showing through as though each strip was mounted in edge guides 19 (not shown here). Each strip is subdivided into ten substantially square length segments with respective markings thereon. Strip 51 of FIG. 4A is a simple reaction time strip, with one segment marked REPLAY and with the other respective segments marked with point scores listed in order from 1 to 9. Strip 52 of FIG. 4B is a different scoring game in which the segments bear + PLAY (take another turn) and − PLAY (lose turn) and point scores of + or − 5, 10, 15, and 20. Strip 53 of FIG. 4C has its segments marked with the parts of the body as listed in the usual "Hangman" game. Strip 54 of FIG. 4D is a jigsaw puzzle simulation in which its segments carry not only representations of puzzle pieces but also identifying numbers from 1 to 10. Strip 55 of FIG. 4E is designed for card game simulation and has each of its segments marked with the customary alphanumeric indicators 2 to 10 and J, Q, K, and A of a suit of playing cards.

Operation of the described apparatus of this invention as a game toy is readily understood. When the game toy is off a player first presses the ON/OFF button once to turn it on. Then pressing the START button lights the LED's in unidirectional sequence, as from left to right when the START button is on the right and the STOP button on the left relative to the player. Preferably as here the sequencing repeats rather than stopping when one pass has been completed from one side to the other, as otherwise the player may not succeed in stopping the sequencing before its completion. When a player presses the STOP button the light sequencing stops, and the player receives the score or other reward (or penalty) indicated in the segment illuminated by the last light lit in the sequence.

As for the operation of the circuitry, a player pressing the ON/OFF button momentarily applies the available positive potential to the SCR grid, causing conduction and thereby actuating the TIMER. A positive potential of six volts is convenient and effective as B+.

The TIMER functions as a multivibrator and outputs periodic pulses, at a rate controlled by the setting of the variable SPEED resistor, to the input of the COUNTER. A succession of output pulses from the COUNTER results, lighting each of the indicator lights in turn, from left to right, and repeating indefinitely.

Pressing the STOP button removes the positive potential from the SCR grid, whereupon it ceases conducting, stopping the TIMER from providing any more output pulses, thus stopping the COUNTER in its then existing state of conduction. Pressing the RESET button applies the positive potential to reset the COUNTER preparatory to the next run, which then is available upon demand and will begin whenever a player again presses the START button. At the end of play, depressing the ON/OFF push-button once toggles the toy off.

Regardless of the overlay in use, a player will undertake to press the STOP button so as to stop the cycling of the LED's with a desired point or reward segment last illuminated, whether during the first or a succeeding cycle. The highest scores or greatest success will be dependent upon eye-hand coordination and reaction time, which are valued characteristics in all or most sports. Where the object is to get a high score, as with straight reaction time or numbers games, the highest point segments will be favored. Where the object is to stop on each segment at least once, as in Hangman or the jig-saw puzzle game, the valuable segments will diminish in number until only one is left, accentuating the value of accuracy. In a more complex game, such as poker or other card game, exogenous rules of the game will alter the values of the respective segments as play progresses and will add further interest to manipulation of the toy to attain the cards necessary to win.

A second embodiment of this game toy appears in the remaining diagrams, in which parts corresponding in structure or function to those of the first embodiment already described are numbered with reference numerals larger by one hundred, and wherein parts without antecedent in the previous embodiment have three-digit reference numbers starting with 1 and ending with two digits not already used. This simplifies comparisons and renders it unnecessary to mention each corresponding part where the analogy is apparent. Occasionally a letter or a prime may be added to a reference number, as where the new embodiment has more than one feature similar to a single feature of the previous embodiment.

FIG. 5 shows, similarly to FIG. 1, the top surface of game toy 110 having housing 112, differing mainly from the previous embodiment in having parallel rows of lights 120 and 120', separate START buttons 122 and 122', auxiliary START buttons 132 and 132', and speed-control knob 125 and MODE switch knob 124 with markings 1, 2, and 3 for the switch settings. (Visible similarly to the FIG. 1 embodiment are ON/OFF toggle button 121 and speed-control knob 125.) Trio of edge guides 119 define a pair of overlay locations so that a given pair of overlays can be interchanged in position and so that one or more overlays can be substituted for either or both of them. As shown further in the next view (and discussed later) this embodiment provides more operational versatility in the playing of games.

FIG. 6 shows (as did FIG. 3 for the first embodiment) circuitry of this more complex embodiment. TIMER 144, which may be unchanged, COUNTER 145 (such as a synchronous up/down chip 74LS193), and added DECODER 148 (such as a 74154 chip) are the major components. Also new are individual NAND gates G101, G102, G103, and G104 (such as one-fourth parts of a quadruple two-input 7600 chip). ON/OFF switch 101, START switch S102, STOP switch 103, and RESET switch 104 are supplemented by MODE switches S105A and S105B--whose positions are marked 1, 2, and/or 3 in conformity with FIG. 5 MODE switch knob settings on the panel.

The TIMER is connected similarly to the previous embodiment, but the output from its pin 3 feeds both NAND gates G101 (pin 2) and G102 (pin 4), whose outputs (pins 2 and 4) connect to respective pins 4 (count down) and 5 (count up) of the COUNTER. COUNTER output pins 2, 3, 6, and 7 are connected to DECODER input pins 23, 22, 21, and 20, while strobe input pins 18 and 19 are tied to ground pin 12 and grounded. LED's are connected to respective DECODER pins 1 to 11 and 13 to 17, to which are attached respective LED's (one each), the common side of the LED's being connected to START switch S102 through resistor R104. DECODER $V_{CC}$ pin 4 connects to NAND Gate $V_{CC}$ pin 16 shown at the side of G101. Ground pin 7 shown at the side of G102 connects to ground pin 12 of the DECODER. Inputs are provided to G103 pins 9 and 10 from DECODER pin 17 (at its junction to the rightmost LED) and from the output of G104.

The output from pin 8 of G103 goes to input pin 1 of G101 and to input pin 12 of G104. The output from G104 goes to input pin 10 of G103 and to input pin 5 of G102. The other input to G104 (pin 13) is from n.o. MODE switch S103B contact——connected to the junction of the leftmost LED at pin 1 only when the switch arm is closed (mode 3) from its n.o. position (mode 2)——but then only when MODE switch n.o. (mode 1) S103A is closed (mode 2/3) to ground.

The second row (not shown here) of LED's may be used in parallel with the first row, one row being switched in and the other out, or a separate decoder with such lights may be switched in and out.

Operation of this latter embodiment is readily understood. In mode 1, this embodiment resembles the first (though with more LED's) in sequencing the lighting from left to right and repeating until stopped (the rightmost LED does not light in this mode). In mode 2, however, the rightmost LED leads off as the first one lit, and the lights sequence in the opposite direction, from right to left only. In mode 3, the mode 1 and mode 2 lighting sequences occur alternately and continually, as the lighting proceeds from left to right and back to left, repeating until stopped. As noted above, if it is not desirable to light both rows of lights alike, appropriate switch means can remove one set whenever the START (or the RESET) switch is actuated, whether by changing the light connections electronically or mechanically or by interchanging B+ interconnection of leads of a DECODER with green LED's for a like DECODER with red LED's.

No special materials of construction are required in the practice of this invention. Representative electronic chip sets suited to the practice of the invention have been identified above; others may come to the mind of persons skilled in the electronic arts.

It will be understood that, when there is only one player, an added play (when awarded or when required by the rules) may be taken simply by taking another turn with the same indicia strip or, with an available second indicia strip. Also, although an indicia strip can be replaced by another between plays, two indicia strips in place continuously are more convenient——except perhaps whenever the game in use is to be changed.

FIGS. 7A through 7F illustrate pairs of reward/penalty strips, one marked "green" and the other marked "red" in accordance with the corresponding LED color, for use with different games.

FIG. 7A is directed to a torpedo game in which the players decide in advance the number of hits to sink a ship and how many ships each player has. The winner is the player who first sinks the other player's ship(s). The green strip's segments indicate how many torpedoes fire when any given segment is the last one illuminated in the green row——none when labeled "miss fire." The red strip's segments indicate whether a torpedo hit of missed, or gives the player another play. It will be understood that a player first plays the green strip to determine how many torpedoes fire, and then plays the red strip to ascertain the outcome of each such firing.

FIG. 7B shows strips for a car racing game. Before play is started the players decide how many laps they will play, each player's set of consecutive turns on the green strip being one lap. A "caution" segment on the green strip causes a play on the red one.

FIG. 7C is set up for a baseball game. Play on the green strip only except as "contact" occurs, in which event that play continues to the red strip. The rules of baseball known to the players apply.

Figure 7D:
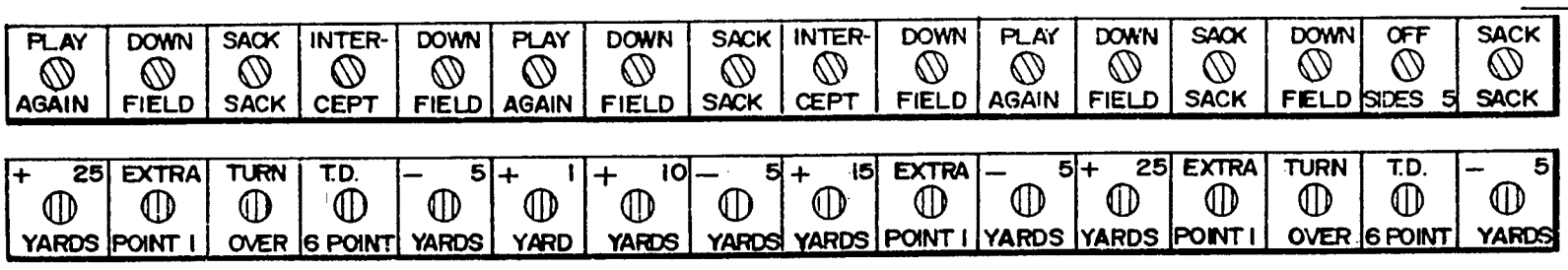

FIG. 7D is directed to football. Play on the green strip leads to the red strip only when "down field" is in the last lit segment, whereupon the last lit red strip segment determines the outcome.

Figure 7E:
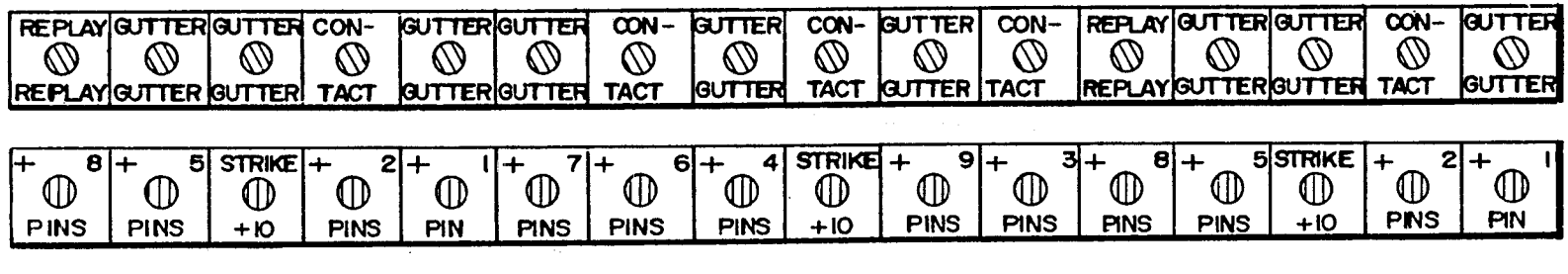

FIG. 7E is set up similarly for bowling, where "contact" on the green strip leads to the red strip to determine the outcome. Each player not receiving a strike on the first play goes again to complete the current play in an attempt for points and/or a spare (at least a 10 total), as in bowling.

Figure 7F:
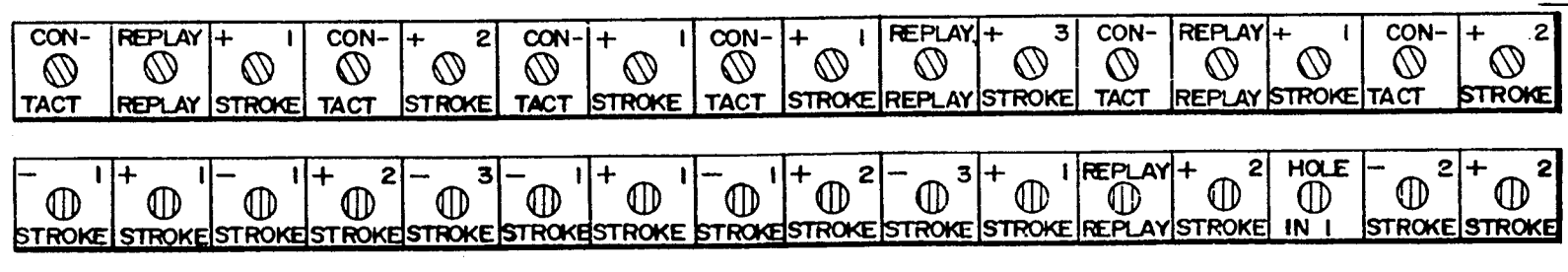

FIG. 7F is directed to golf. Here again "contact" on the green strip leads to a play on the red strip.

It will be further apparent that this game toy can be adapted to other two-sided games, such as tennis or soccer, by appropriate changes in the indicia strips; and to many-sided games, as well, such as arbitrary journeys with various hazards and rewards. Regardless of whether a player is simply competing with the toy——so to speak——or himself or herself (when playing alone) or is competing against one or more other persons, the degree of difficulty can be selected by setting the speed-control knob appropriately.

Preferred embodiments and variants of the reaction-time game toy of the present invention have been shown and described. Other changes may be made in such apparatus and procedures, as by adding or deleting, subdividing or combining, or otherwise modifying parts or steps, while retaining at least some of the many advantages and benefits of this invention——which itself is defined only in the following claims.

I claim:

1. Competitive game toy, comprising a plurality of indicator lights located along a given path, motor-free control means adapted to light the lights in a given sequence, start means manually actuatable to begin light sequencing, stop means manually actuatable to halt light sequencing at any light, and, adjacent the path, a removable award strip bearing reward or penalty markings.

2. Game toy according to claim 1, wherein such strip bears as many such markings as there are indicator lights and locates such marking adjacent the respective lights.

3. Competitive game toy comprising a row of individually lightable indicator lights, electronic means adapted to light the lights in a given sequence, start means manually actuatable to begin light sequencing, stop means manually actuatable to halt light sequencing selectively at each light, and award strip means illuminated by successive indicator lights, bearing reward or penalty markings adjacent the respective lights.

4. Toy according to claim 3, including manually actuatable means adapted to reset light sequencing.

5. Toy according to claim 3, adapted to provide light sequencing in the same direction from either selected end of the row to the other end of the row, and including in the electronic means an up-and-down counter.

6. Toy according to claim 5, also adapted to provide a mode of light sequencing repeatedly from end to end and back in the opposite direction.

7. Toy according to claim 3, including a plurality of rows of such indicator lights, each row being separately sequenced.

8. Toy according to claim 7, including also a like plurality of award strip means, one such strip means for each such row.

9. Toy according to claim 8, wherein the strip means bear markings corresponding to play outcomes in conventional sport.

10. Competitive electronic game toy for one or more players, comprising a housing with two rows of aligned indicator lights visible from outside and with circuitry adapted to light either row of indicator lights according to a preselectable sequence and rate, each said row having adjacent thereto removable game-related award means, said removable award means being striplike in the sense of having substantially narrow uniform width relative to its length, and being divided into length segments, each said length segment having noted thereon a play result collocated with its adjacent indicator light.

11. Toy according to claim 10, including inside the housing, electronic means adapted to light said rows of indicator lights according to said preselectable sequence in a preselected direction and at said preselected rate; and available outside the housing, control means adapted to preselect which of said row of indicator lights is to be lighted, said direction, and said rate.

12. Toy according to claim 11, including also adjacent the exterior of the housing, pairs of striplike award means for the respective rows of indicator lights and for the respective games, one said award means for each row of indicator lights, and among the control means, manually actuatable START and STOP controls as preselection means for the respective rows of indicator lights.

13. Competitive game playing method for one or more players, comprising the steps of manually triggering indicator lights to light sequentially from one end to another along a given path divided into successive length intervals having respective game instructions located adjacent said intervals;

manually actuating stop means to halt the sequential lighting of such indicator lights within said path length interval without continuing therealong; and performing a subsequent game step pursuant to one of said game instructions adjacent the interval of the last indicator light so illuminated.

14. Game playing method according to claim 13, including performing a plurality of said subsequent game steps indicative of a hangman game.

15. Game playing method according to claim 13 including performing a plurality of said subsequent game steps indicative of a torpedo game.

16. Game playing method according to claim 13 including performing a plurality of said subsequent game steps indicative of a racing game.

17. Game playing method according to claim 13, including performing a plurality of said subsequent game steps indicative of a baseball game.

18. Game playing method according to claim 13, including performing a plurality of said subsequent game steps indicative of a football game.

19. Game playing method according to claim 13, including performing a plurality of said subsequent game steps indicative of a bowling game.

20. Game playing method according to claim 13, including performing a plurality of said subsequent game steps indicative of a golf game.

* * * * *